US005370270A

United States Patent [19]

Adams et al.

[11] Patent Number: 5,370,270

[45] Date of Patent: Dec. 6, 1994

[54] NON-SPILL BOTTLE CAP USED WITH WATER DISPENSERS

[75] Inventors: Brian M. Adams, Newark; Daniel Luch, Morgan Hill, both of Calif.

[73] Assignee: Portola Packaging, Inc., San Jose, Calif.

[21] Appl. No.: 79,070

[22] Filed: Jun. 16, 1993

Related U.S. Application Data

[63] Continuation-in-part of Ser. No. 772,949, Oct. 8, 1991, Pat. No. 5,232,125.

[51] Int. Cl.[5] ..... B67D 5/00

[52] U.S. Cl. ..... 222/88; 222/129; 222/153; 141/330; 141/363; 220/254; 220/270; 215/254; 215/296

[58] Field of Search ..... 222/88, 83.5, 129, 146.6, 222/153, 484, 185; 141/18, 319, 330, 346, 363; 62/391; 220/270, 254, 256; 215/251, 254, 296

[56] References Cited

U.S. PATENT DOCUMENTS

| | | | |
|---|---|---|---|
| Re. 32,354 | 2/1987 | Savage | 222/81 |
| 4,699,188 | 10/1987 | Baker et al. | 141/18 |
| 5,031,676 | 7/1991 | Ulm | 141/346 |
| 5,121,778 | 6/1992 | Baker et al. | 141/346 |
| 5,232,125 | 8/1993 | Adams | 222/146.6 X |

FOREIGN PATENT DOCUMENTS

WO903919 4/1990 WIPO ..... B65B 3/06

*Primary Examiner*—Gregory L. Huson
*Attorney, Agent, or Firm*—Julian Caplan

[57] ABSTRACT

A cap composed of a snap-on, tamper-evident closure differing from others of this general type is formed with a central sleeve. The bottom of the sleeve is closed off by a removable plug. The exterior of the closure is formed with a bead. The water dispenser is provided with an adapter consisting of an open-bottom outer sleeve into which the neck of the container with the closure in place thereon fits. Centrally disposed in the outer sleeve is a dispenser tube. When the container is inverted its neck is inserted in the outer tube. As the neck and cap are lowered, the dispenser tube enters the cap sleeve and attaches to the plug. Continued lowering of the container causes the plug to slide out of the tube so that liquid in the container flows out through the dispenser tube into the dispenser. When the container is lifted, the plug (which has been attached to the dispenser tube) is pulled back into its original sealed position. The plug and cup are at all times discrete. At least portions of the exterior of the skirt of the plug and a bead on the inside of the well near its bottom edge are also seamless. The portions are seamless in the sense of absence of vertical mold parting flash and thereby seal effectively. The exterior skirt of the plug and the interior wall of the well sleeve are seamless.

27 Claims, 5 Drawing Sheets

NON-SPILL BOTTLE CAP USED WITH WATER DISPENSERS

CROSS REFERENCE TO RELATED APPLICATION

This application is a continuation-in-part of co-pending application Ser. No. 07/772,949 filed Oct. 08, 1991 now U.S. Pat. No. 5,232,125. The subject matter thereof is incorporated herein by reference.

BACKGROUND OF THE INVENTION

1. Field of the Invention

This invention relates to a new and improved bottle cap used to close containers of the type used on water dispensers and water coolers. More particularly, the cap has tamper-evident features and, more specifically, is constructed so that it may be applied to conventional containers (e.g., 5-gallon water bottles) using conventional capping equipment. The cap is formed with an open-ended well in the center which is initially closed by a slidable plug. The invention further comprises the use of such a cap with a dispenser system having a dispenser tube which fits into the well, engages the plug and pushes the plug away from the well. When the container is empty or nearly empty, as the container is removed from the dispenser, the tube pulls the plug back into its initial position, preventing any liquid remaining in the container from spilling.

2. Description of Related Art

U.S. Pat. No. Re. 32,354 discloses use of a flexible bag contained within a box fitted with an adapter which seals around an opening in the bag and is secured to an opening in the box. A tubular spigot probe is inserted into the adapter to engage a movable plug within a sleeve which is a permanent part of the adapter. As the probe is inserted into the sleeve, it seals thereagainst and also fastens itself to the plug. Continued insertion of the probe pushes the plug inwardly of the bag. When the probe is withdrawn, the plug is pulled back into the sleeve. The present invention constitutes an improvement over U.S. Pat. No. Re. 32,354 in that the adapter of that patent is considerably modified so that the present invention embodies a modification of a conventional bottle cap adapted to snap onto a conventional, large bottle for liquids such as water bottles. The box of U.S. Pat. No. Re. 32,354 in which the bag is contained is entirely eliminated in accordance with the present invention. In one embodiment of the present invention, applicant's plug is formed with external longitudinal grooves and notches in the bottom edge of the plug aligned with the grooves making the skirt flexible and facilitating re-entry of the plug into the sleeve. The grooves and notches facilitate ejection of the plug from the mold in which it is fabricated. The grooves further initiate communication between the container and the exterior earlier than would otherwise be the case.

U.S. Pat. No. 4,699,188 shows a water dispensing system using a conventional large liquid container closed with a snap-on type cap having a well formed therein initially closed with a frangible bottom. The dispenser has a tube formed with a point which penetrates the bottom of the cap well and permits discharge of liquids through the dispenser tube. A disadvantage of the structure of this patent is that there is no means for reclosing the bottom of the well. Hence, when the container is removed, if any liquid remains therein it leaks through the pierced bottom of the capped well.

PCT Publication WO90/0399 discloses an improvement upon U.S. Pat. No. 4,699,188. U.S. Pat. No. 5,121,778 is an improvement upon the PCT Publication. In these structures, the bottom of the cap well is initially closed by a plug integrally formed with the well. When the container is installed in a dispenser, a tube of the dispenser fits into the well and engages the plug. Continued movement of the container causes the dispenser tube to break the connection between the plug and the well and pushes the tube into the container, allowing liquid to be dispensed through the tube. When the container is removed from the dispenser, the tube pulls the plug back into the well and then disengages therefrom, whereby the plug prevents leakage of the liquid. The present invention comprises an improvement on the above reference in that the plug is not formed initially as part of the well, but is a separate member inserted therein. Thus the present invention provides improved dimensional control for the plug engaging the dispenser tube and being disengaged therefrom when the plug is reinserted in the well. Further, the interfitting sealing surfaces of the well and plug of the present invention are seamless and, therefore, smooth. One embodiment of the present invention uses longitudinal grooves on the exterior of the plug skirt below the seamless circumferential bead on the skirt which seals against the seamless interior of the well. Hence the seal of the plug is broken as soon as the plug moves a short distance relative to the well, an event which occurs before the probe or dispenser tube locks on the plug.

SUMMARY OF THE INVENTION

The present invention is used on adapters for liquid dispensers of a type commercially available. Such a dispenser adapter has an outward-flaring upper end which merges into a cylindrical lower end dimensioned to receive an inverted liquid container with the cap intact thereon. Centrally disposed in the cylindrical lower end of the adapter is a dispenser tube, the upper end of which is formed with a groove to interact with the plug of the cap as hereinafter described.

The container is a conventional container having a neck formed with a lip and has on its exterior a convex bead merging with the lip and a concave depression below the bead.

The cap of the present invention has certain features of conventional caps used to close such containers and is of a tamper-evident, snap-on type. Conventional caps are formed as a single injection molded member having a top disk which fits over the lip of the container neck, a rounded corner outward of the disk having internal seal beads which seal against the lip's surface and a skirt depending from the rounded corner. Part way down the interior of the skirt is a tension ring which fits against the underside of the neck bead and securely retains the cap on the neck. A finger grip depends from the lower edge of the cap skirt. Adjacent the finger grip is an upwardly curved score line which merges with a horizontal score line immediately below the closure tension ring. When the user grips the tear tab and pulls upwardly, the cap skirt tears along the curved score line and then at least partially around the horizontal score line, loosening the lower skirt from contact with the neck so that the cap may be removed. As illustrated in the accompanying drawings, there may be internal radially spaced standoffs such as shown in U.S. Pat. No.

4,911,316 which engage the container neck. These standoffs facilitate installing the cap on the container neck and also prevent inward pinching of the cap skirt in the region of the concavity of the container neck.

The present invention differs from the caps of the above described type in that a central well is formed in the top of the cap, joined to the cap by a curved intermediate portion. The interior of the well near the bottom thereof is formed with an inner bead. The open bottom of the well is initially closed by a plug. The plug has a top and a plug skirt, surrounding the top and attached thereto. An upward extending cylindrical extension joins the top of the skirt to a peripheral flange of a larger diameter than the interior of the well in one form of the invention. The cylindrical extension or the plug skirt itself is formed on its exterior with a first circumferential groove below the peripheral flange and a second circumferential groove below the first groove with a seamless circumferential sealing bead between the two circumferential grooves. In certain forms of the invention, communicating with the second groove are longitudinal diametrically opposed grooves. Notches are formed in the bottom edge of the plug skirt intersecting the longitudinal grooves. The plug has a seamless in-turned flange at its bottom edge and a lower outward directed shoulder on the plug skirt exterior above the notches.

The well has an in-turned bead at its inner edge which contacts the plug circumferential seamless sealing bead and holds the plug in the well particularly by contacting the plug outward directed shoulder against unintentional dislodgement. The plug skirt sealing bead seals against the inner wall of the in-turned well bead so long as the plug is fully seated in the well.

In some forms of the invention the plug is formed with a circumferential external seamless sealing bead at a location along the plug skirt. The lower end of the plug skirt is formed with an external shoulder. The interior of the upper end of the well is formed with an internal seamless bead. When the plug is fully seated, the well bead seals against the plug bead. When the plug approaches its unseated position, the well bead engages the plug shoulder and holds the plug in the well until it can attach to the dispenser probe.

By reason of the construction of the plug it may be injection molded without the use of slides since the cylindrical extension is quite flexible and hence is readily ejected from the mold. Thus the plug sealing bead is formed without vertical parting lines. Similarly, the cap is molded in one piece without vertical parting lines and the well is thus seamless. Further, the well is molded integral with the other portions of the cap and welding is unnecessary. The seal of the plug sealing bead against the well is thus tight.

It will be understood that containers closed with caps according to the present invention are frequently used with dispensers other than those herein described. In other words, the cap is removed from the container prior to installation in the dispenser. Furthermore, even when the cap has not been removed by the consumer, when the container has been returned to the bottling plant, it is necessary to remove the cap in order to refill the bottle. Accordingly, in accordance with the present invention, a finger grip and upwardly curved and horizontal score lines are included, these features being similar to those of conventional prior art caps.

Optionally, there is located on the exterior of the cap skirt an external cap bead. Although the dispenser preferably used with the present invention does not require the use of such a bead, the bead is of a greater outside diameter than any other portion of the cap and is intended to form a seal with a dispenser adapter of a different type than the preferred adapter. The exterior bead also assists in gripping the cap during transport.

The preferred adapter use, d with the present invention is conventional and has an outward diverging flared upper end which merges into a cylindrical lower end and is shaped to receive and center an inverted container capped with the cap of the present invention. Disposed centrally within the cylindrical lower end of the adapter is a dispenser tube or probe. The tipper end of the dispenser tube is preferably closed off and rounded. Immediately below the upper end of the tube is a groove shaped to engage the in-turned flange on the lower end of the cap plug. When the container is inverted and lowered into the adapter, the dispenser tube end penetrates the well of the cap and fits inside the skirt of the plug.

The first movement of the cap relative to the dispenser tube is to move the plug upward relative to the well so that the in-turned bead of the well moves out of contact with the plug sealing bead. The longitudinal plug skirt grooves, if used, thus break the seal of the container creating communication between the interior and exterior of the container.

The second movement of the cap relative to the dispenser tube occurs when the in-turned well bead contacts the outward directed shoulder of the plug to hold the plug stationary relative to the well, whereupon the in-turned plug flange seats in the groove of the dispenser tube.

The third such movement results in pushing the plug into the interior of the container. However, it will be understood that the plug does not float loose within the container, but is held attached to the upper end of the dispenser tube. There are dispensing holes in the dispenser tube through which liquid within the container flows and thence through the tube into the dispenser.

When the container is empty or at any time when it is desired to remove the container, it is lifted relative to the dispenser. The cap therefore retracts relative to the dispenser tube and the plug seated on the dispenser tube is pulled back into the well. Chamfers on the bottom edges of the well and plug facilitate the plug re-entering the well. The longitudinal grooves on the plug skirt and notches on the edge of the skirt, if used, facilitate reinsertion of the plug in the well since the end of the plug is quite flexible and can be contracted as the plug skirt enters the well. When the peripheral flange on the plug engages the bottom edge of the well, the plug is pulled off of the dispenser tube, resealing the cap. Hence, if liquid remains in the container it does not leak.

The cap and plug of the present invention are injection molded of low density polyethylene, or other suitable plastic, each as a single piece in a mold which requires no slides, nor any welding of parts. Hence essential cooperating seal surfaces of the plug and well are "seamless"—characterized by the absence of mold flash.

It will be understood that the cap of the present invention is tamper-evident. Initially a label covers the top of the cap. The label prevents dirt or liquids from entering the well and hence provides a sanitary protection for the cap. Additionally the label may contain the name of the bottler and any other information required by law or of other interest. Removal of the label gives some evidence of tampering. Moreover, it will be understood that if the plug in the bottom of the cap well is pushed into the container in order to tamper with the contents of the container, there is no means for replacing the plug. He:nee, displacement of the plug is further evidence of tampering. The only way the plug can be returned into its initial position at the bottom of the well is by means of the dispenser tube as heretofore described.

One of the advantages of the invention is the fact that the cap may be used with conventional containers and no special containers are required. Still another advantage of the invention is the fact that when the filled container is used with a dispenser other than that with which it is primarily intended, the cap may be removed by the consumer while the bottle is in upright position by gripping the tear tab and tearing the bottom of the skirt and then removing the upper portion of the cap.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
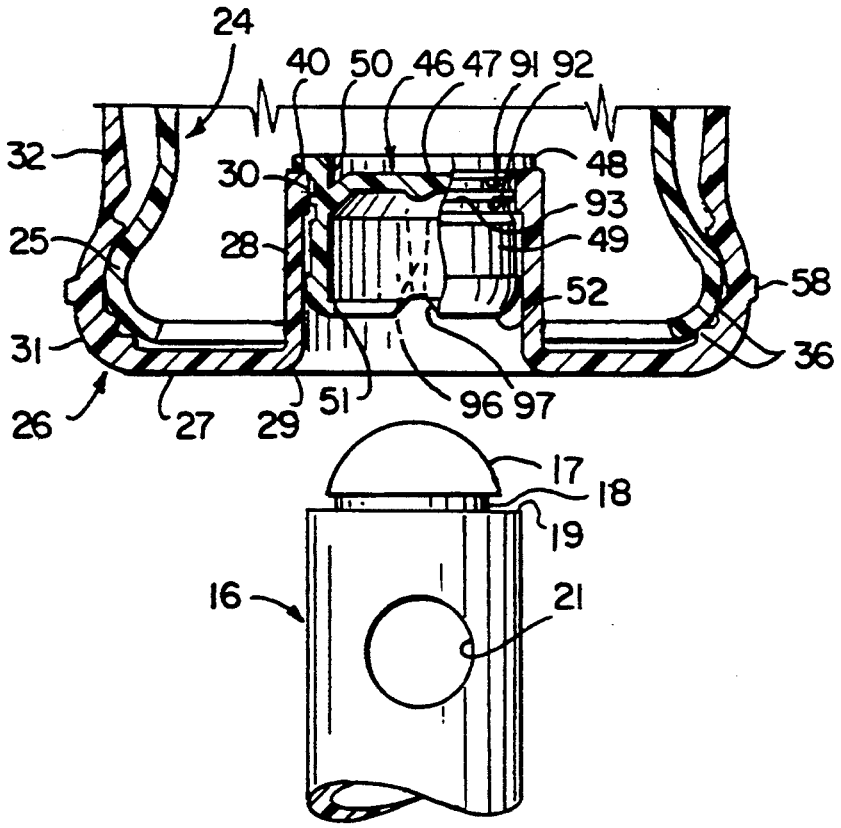
FIG. 1 is a schematic view showing a portion of a dispenser adapter and a cap in accordance with the present invention as the cap is being lowered into the dispenser.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The neck and shoulder of a conventional large water bottle (such as a 5-gallon water bottle conventionally used in the United States) when inverted fits within a conventional water dispenser. The dispenser is provided with a dispenser tube 16 having a rounded closed upper end 17. The exterior of tube 16 has a groove 18 formed therein a short distance below the end 17 and has a shoulder 19 immediately below the groove 18. Below the shoulder 19, tube 16 is of larger diameter than end 17. There are four holes 21 in tube 16 through which water from the container installed in the dispenser may flow down through the bottom of the tube 16.

Cap 26 fits on a container neck 24. Cap 26 has an annular top 27 formed with a central well 28 having cylindrical side walls and extending down into the cap. A curved corner 29 connects the cylindrical well 28 with the annular top 27. Well 28 is seamless—there is not a vertical parting line or flash. Adjacent the bottom of well 28 but spaced slightly upward thereof is inturned flange or bead 30. Chamfer 40 is formed on the bottom edge of well 28.

The remainder of the cap 26 resembles a commercially available cap extensively used for large water containers which are not intended for use with dispensers of the type heretofore described. Such a cap has a rounded corner 31 disposed outwardly of the top 27 and below the corner 31 is a depending skirt 32. A tension ring 35 is located on the inside of the skirt 32 in a position to fit under the neck bead 25 of neck 24 and draw the corner 31 toward the neck bead. Preferably, there are upper and lower internal seal beads 36 on the inside of the wall of the corner 31 which tightly engage the container lip 23 and seal against leakage. Standoffs 34 are radially spaced apart and inward projecting to hold the wall of the skirt 32 outwardly of the concavity 22 of the container neck and also facilitate pushing the cap 26 onto the neck 24.

In order to loosen the lower portion of the skirt 32 so that cap 26 may be removed from neck 24, a tab 39 extends downward from the bottom edge 38 of the skirt 32 and is formed with transverse finger grip ridges 41 to facilitate pulling the tab. Curving upwardly from bottom edge 38 adjacent the tab 39 is a score line 42 which merges with a horizontal score line 43 immediately below tension ring 35. By pulling upward on the tab 39, the skirt tears along the score line 42 and thence along a sufficient portion of score line 43 so that the lower portion of skirt 32 releases its grip on neck 24. So long as the skirt 32 is intact on container neck 24, it is practically impossible to remove the cap 26. Once the lower portion of the skirt is loosened, the upper portion of the cap may be removed and used as a reclosure cap.

It will be understood that in the preferred practice of the present invention, the cap 26 is not removed prior to installation of the container in the dispenser. However, many times the consumer may wish to use the container in a different type of dispenser. Further, after the container has been returned to the bottling works, it is necessary to remove the cap 26 before the bottle is sterilized and refilled. Hence, the tab 39, score lines 42 and 43 are used for such purposes. A buttress or internal thickening 44 is formed adjacent the intersection of bottom edge 38 and the bottom of score line 42 to prevent unintentional tearing of the skirt along any lines other than the line 42 and 43. The buttress 44 assists in confining the tear to the proper line.

In some instances the cap may be used in dispensers other than those heretofore described. In the preferred embodiment heretofore described, as hereinafter will appear, the exterior of the dispenser tube 16 fits tightly against the inside bore of the well 28. In some instances, however, it is desirable that the cap 26 seal against the inside of the equivalent of a cylindrical portion 61 of the dispenser (See FIGS. 9 and 10). For such purpose as well as for other purposes, external cap bead 58 is formed on the upper part of the skirt 32. The outside dimension of the bead 58 is greater than any other area of the cap 26.

For tamper-evident purposes a label (not shown) may be adhered to the top of the cap 26. Various labeling information such as the name of the bottler and information as to the contents of the container may be printed on the label. Further, the label covers the well 28 and prevents dirt, liquids or other contaminants from entering the well. Additionally, the label is a tamper evident feature since once it is removed it gives evidence that there may be tampering with the contents of the container.

Figure 7:
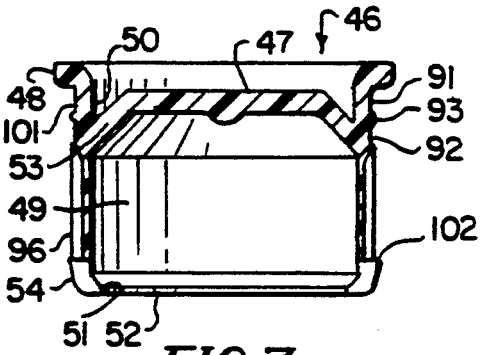
FIG. 7 is a sectional view taken along the line 7—7 of FIG. 6.
Figure 8:
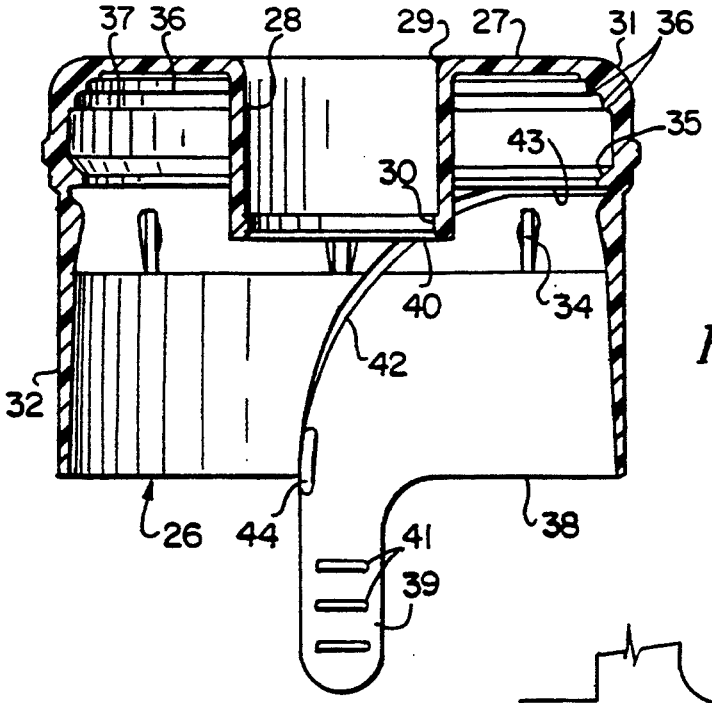
FIG. 8 is a vertical sectional view through a cap with plug removed.

The lower end of well 28 is closed by a slidable plug 46. Plug 46 has a top comprising closed disk end or top 47 at its center and, as shown in FIG. 7, downwardly-outwardly directed conical wall 50. Skirt 49 intersects wall 50 at a circular junction area 53 and extends below the outer end of wall 50. When as later appears, plug 46 is ejected from its mold, ejector pin 88 pushes against end 47, wall 50 is under tension and this is transferred at junction area 53 to skirt 49 (FIG. 18) pulling skirt 49 out of the mold without danger of breakage. A cylindrical upward directed extension 101 is attached to the upper end of skirt 49 (see FIG. 7). An out-turned flange 48, the outer edge of which is of a larger diameter than any other portion of the plug, is positioned at the upper end of the cylindrical extension 101. Below the flange 48 is a first circumferential groove 91. Below groove 91 is second groove 92 and separating the two is circumferential seal bead 93 which, as shown in FIG. 1, seals against in-turned bead 30 at the inner end of well 28 when plug 46 is fully seated in well 28. It will be noted that both bead 93 and bead 30 are "seamless"—i.e., devoid of mold-parting flash. At the lower edge of skirt 49 is a chamfer 54 and inward thereof is an in-turned flange 51. Above chamfer 54 is lower shoulder 102 (see FIG. 7).

In the modification of FIG. 1, grooves 96 extend longitudinally on the exterior of skirt 49 from second groove 92 toward the end of the skirt. Notches 97 are formed in the bottom edge 52 of skirt 49 in line with grooves 96. Thus, when plug 46 is in the position of FIG. 2, grooves 96 establish communication between the interior of neck 24 and the exterior, breaking the seal of the container, allowing air to enter and liquid to flow from the container.

As shown in FIG. 1, plug 46 is initially installed in well 28 at the time of manufacture. Seal bead 93 seals against bead 30, sealing the container. Flange 48 abuts the bottom of well 28, limiting inward movement of plug 46.

The assembled cap 26 and plug 46 are shipped as a unit from the cap manufacturing facility. The cap 26 may be snapped onto the container neck 24 in the same manner and by the same equipment as used with conventional caps and necks. The cap is tamper-evident, first because the label prevents tampering with the plug 46, and tension ring 35 and the engagement of skirt 32 with neck 24 prevent the cap from being removed from the container neck until the skirt is torn away.

Further evidence of tampering is afforded by the presence or absence of plug 46. Only by use of a dispenser may the plug 46 be re-positioned in well 28 once it has been removed.

Upon delivery of the bottled liquid to the site of the dispenser, contrary to conventional dispensers, in accordance with the present invention the cap 26 remains on the neck 24. The container is inverted and lowered into the dispenser. As shown in FIG. 1, the container remains sealed and hence liquid does not spill from the container during the period of time when the container is being lowered into the dispenser.

Figure 2:
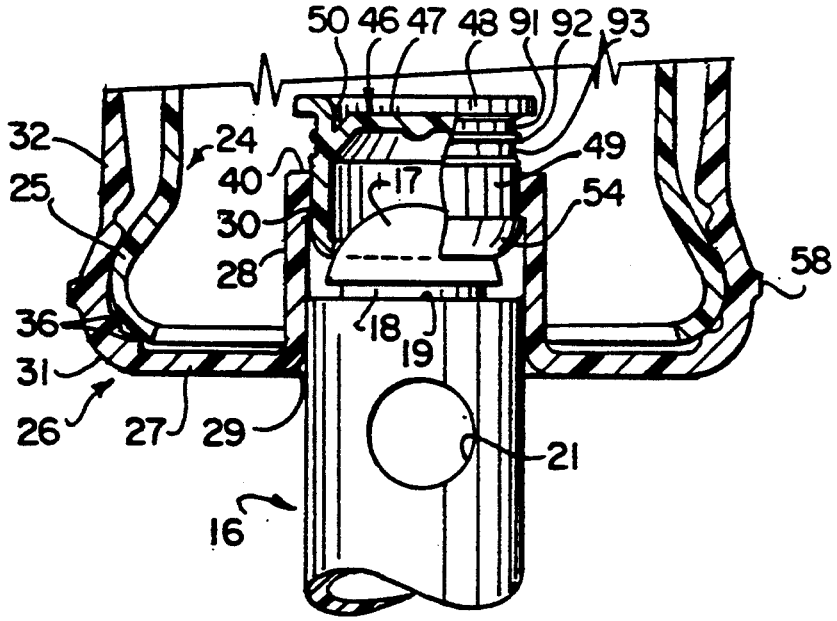
FIG. 2 is a view similar to FIG. 1 showing the cap in the position where it engages the dispenser tube prior to the plug of the cap being attached to the dispenser tube.

As the inverted container is further lowered into the dispenser, as shown in FIG. 2, end 17 of tube 16 contacts the bottom edge 52 of plug 46, moving plug 46 upward relative to well 28 so that longitudinal grooves 96 break the seal of the container allowing air to enter and liquid to leak. Flange 30 engages shoulder 102, holding the plug 46 within the well.

Figure 3:
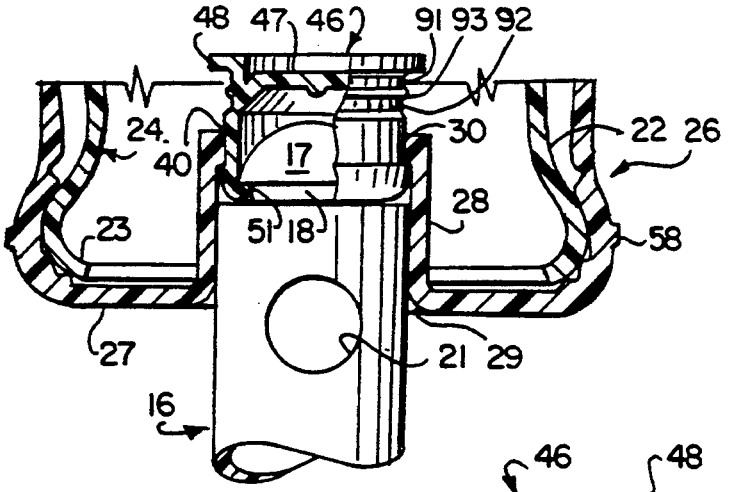
FIG. 3 is a view similar to FIG. 1 showing completion of the insertion of the cap into the adapter, the plug locking onto the dispenser tube.

Further lowering of the container to the position of FIG. 3 results in in-turned flange 51 of plug 46 seating into groove 18 so that plug 46 remains on tube 16 until such time as the container is being removed from the dispenser. Interference of shoulder 102 with well bead 30 insures that plug 46 seats into groove 18.

Figure 4:
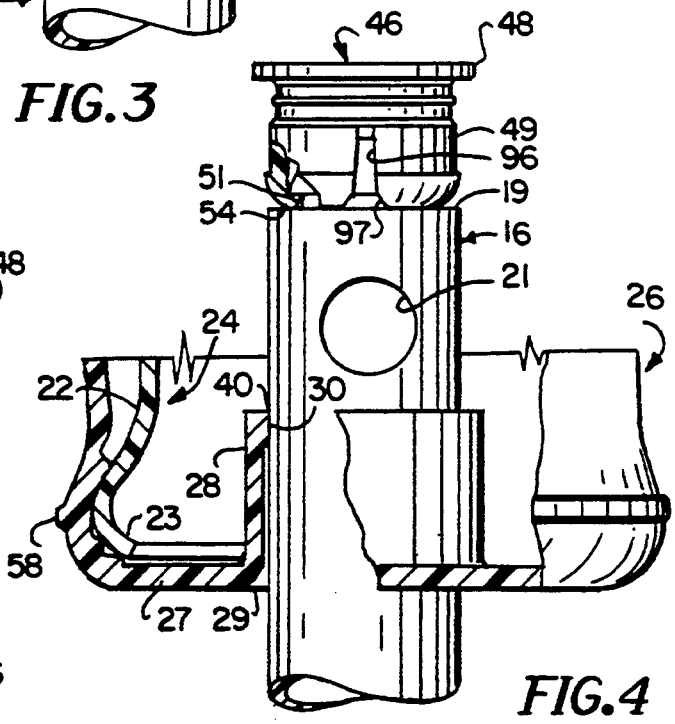
FIG. 4 is a view similar to FIG. 1 showing the dispenser tube fully seated in the cap, the plug being displaced from the cap well.

As the cap and container are lowered to the open position of FIG. 4, the plug 46 is forced upwardly out of the well 28 as flange 30 slips over shoulder 102. The holes 21 in the tube 16 are inside the container and hence liquid can flow through the holes 21 and down through the tube 16 into the dispenser. It will be noted that the plug 46 is firmly gripped on the upper end of the tube 16 and does not float inside the container.

After the contents of the container have been wholly or partially dispensed, the user may remove the container from the dispenser. This operation is the reverse of the previous operations. That is, the container is lifted from the position of FIG. 4 to the position of FIG. 1. Because the in-turned flange 51 of the plug 46 is engaged in the groove 18 of the tube 16, the plug is pulled back into the well 28, chamfers 40 and 54 facilitating entry. The presence of notches 97 and grooves 96 makes the skin 49 quite flexible and compressible. This further facilitates re-entry of plug 46 in well 28. Plug 46 snaps in place because of interfitting of beads 30 and 93. Continued movement to the position of FIG. 1 causes the flange 51 to snap out of the groove 18. Inward movement of the plug 46 relative to well 28 is prevented because of the peripheral flange 48 on the plug. In the position of FIG. 1, the plug 46 prevents leakage of any liquid remaining in the container while the container is being removed and returned to upright position.

When the container is returned to the bottling works, the tab 39 is gripped causing the skirt to tear along the line 42 and partially along line 43. This permits the cap to be removed so that the container may be sterilized, refilled and then recapped.

Figure 9:
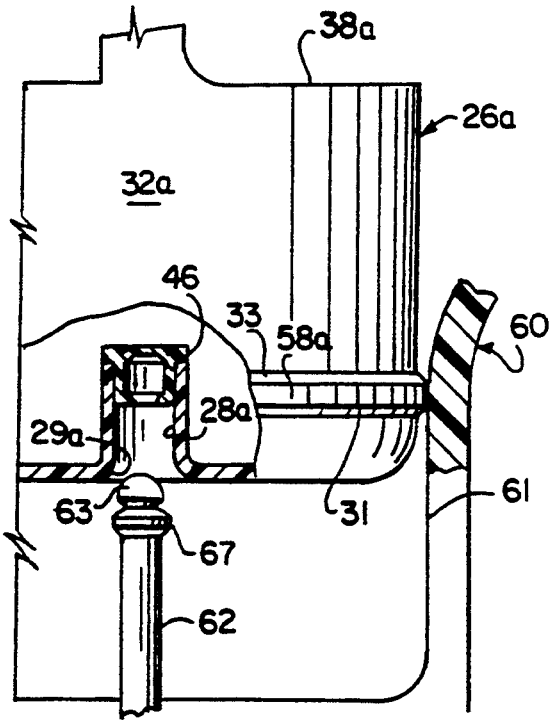
FIG. 9 is a view similar to FIG. 1 of a modified dispenser adapter and a portion of a cap.
Figure 10:
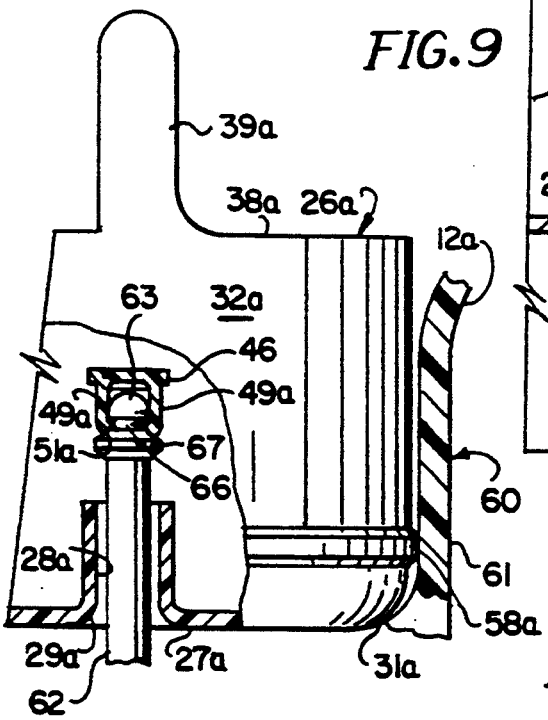
FIG. 10 is a view of the modification of FIG. 9 with the container seated in the dispenser.

FIG. 9 illustrates use of the cap of the present invention with a different type water dispenser. The dispenser has a cylindrical sleeve 60 within which is an upward extending rod 62. Sleeve 60 has an inside diameter which has an interference fit with the external cap bead **58*a* so that the cap 26*a* seals against the cylindrical portion 61 of the sleeve 60. Rod 62 is of a smaller diameter than the tube 16 of the previous modification so that it does not seal against the inside of the well 28***a*. The upper end 63 of the rod 62 is sufficiently small to fit inside the plug skirt 49*a* and the in-turned flange 51*a* seats in the groove 66. Immediately below groove 66 is an enlarged diameter portion 67 which stretches well 28*a* so that plug skirt 49*a* may re-enter well 28*a* when the container is withdrawn from dispenser sleeve 60.

It will be noted that in this modification the seal is by means of the external cap bead 58*a* against the inside of the cylindrical portion 61 of the sleeve 60 and liquid is dispensed by running down the outside of rod 62. In other respects, the modification of FIG. 7 resembles that of the previous modification.

Figure 5:
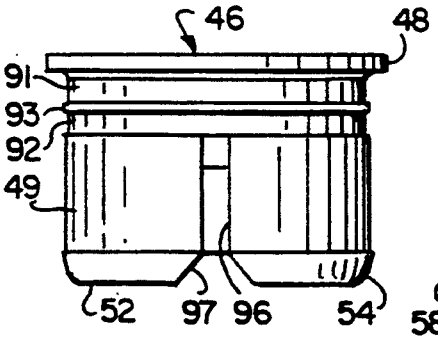
FIG. 5 is a side elevational view of the plug.
Figure 6:
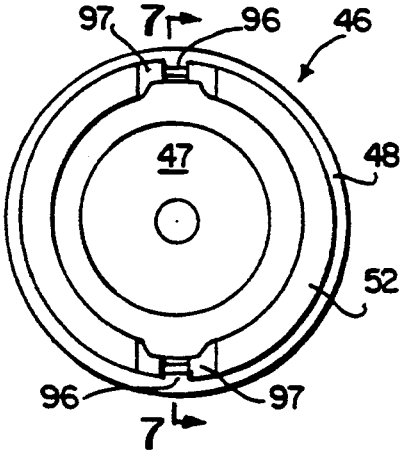
FIG. 6 is a bottom plan view of the plug.
Figure 11:
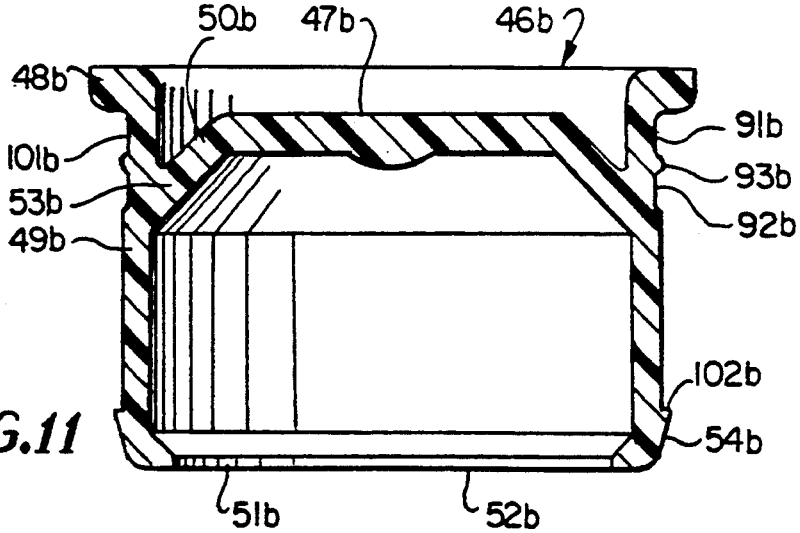
FIG. 11 is a view similar to FIG. 7 of a modified plug.

FIG. 11 shows a plug similar to that shown in FIGS. 5–7 but eliminating the longitudinal grooves 96 and notches 97. Plug 46*b* has a seal ring 93*b* which, in the closed position of the plug, seals against well flange 30 (not shown in FIG. 11). The dispenser tube, after it engages plug 46*b* pushes the same partially out of the well until the flange 30 engages shoulder 102*b*, holding the plug 46*b* partially within the well until the in-turned flange 51*b* is received within the groove 18 (not shown in FIG. 11) of probe dispenser tube 16.

Figure 12:
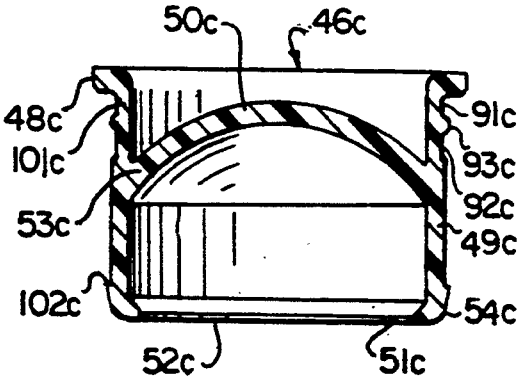
FIGS. 12–15 are views similar to FIG. 11 of further modified plugs.

FIG. 12 illustrates a modification wherein plug top 47 and wall 50 are replaced by a domed wall 50*c* which intersects plug skirt 49*c* at junction area 53*c*. It will be noted that seal bead 93*c* extends circumferentially between the spaced circumferential grooves 91*c* and 92*c* in the same manner as in the preceding modifications. The dome shaped portion 50*c* distributes stress imposed by the mold ejector pin more evenly and the stress is transmitted at junction area 53*c* to pull the lower portion of skirt 49*c* out of the mold.

Figure 13:
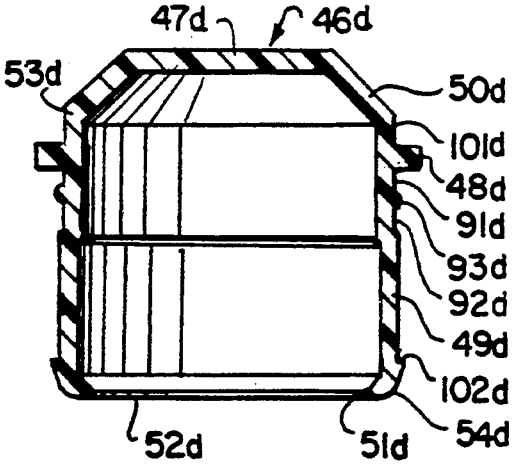

FIG. 13 shows a different construction for the end of plug 46*d*. In this modification the plug top 47*d* is elevated above flange 48*d*. Top 47*d* is of lesser diameter than the plug skirt 49*d*. Wall 50*d* slants downwardly-outwardly and joins upward extension 101*d* at a junction area 53*d* at the tipper end of extension 101*d* without damaging the plug.

Figure 14:
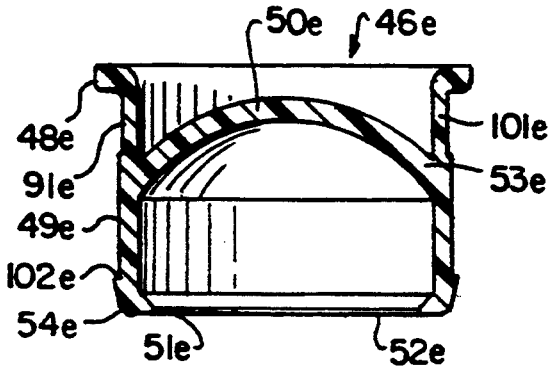

In the modification of FIG. 14, there is a single groove 91*e* in upward extension 101*e* of plug skirt 49*e* of plug 46*e*. The surface of groove 91*e* is "seamless" in the sense that there is no vertical mold parting line on this surface. The inner edge of flange 30 of well 28 (not shown in FIG. 14) is likewise smooth and seamless and engages the surface of groove 91*e*. It will be noted that there is no seal bead corresponding to the bead 93 of FIG. 7 in the modification of FIG. 14. Although sealing may not be as effective, it is sufficient.

Figure 15:
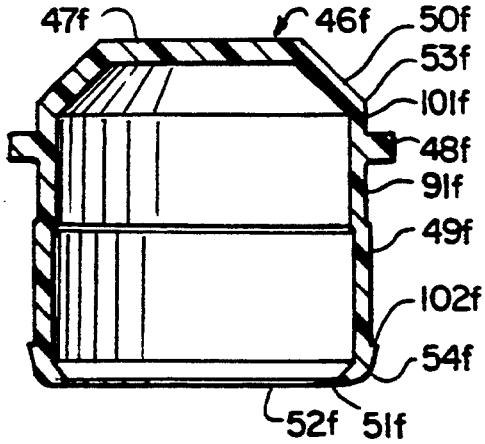

FIG. 15 shows a plug 46*f* having an extended circumferential groove 91*f* characterized by the absence of a seal bead 93 therein.

FIGS. 16 through 19 show sequential and schematically construction of the various mold parts for plug 46 and the sequence of the action thereof. It will be understood that the parts are not described in detail since such details of construction would be understood by expert injection mold designers. What is shown, however, in these drawings are the major features of the construction of the mold parts which makes forming the part without a seam feasible.

The mold comprises a hot side mold part 71 cored out for hot runner 72. The bottom of the part 71 has a protrusion 73 formed with a recessed portion 74. The portions 73 and 74 define the tipper end of plug 46, namely, the closed end 47, wall 50, and the inside surface of flange 48. Gate 76 is formed in the center of protrusion 73 for the discharge of molten plastic. A preferable plastic used in the construction of the cap and the plug is low density polyethylene.

Figure 18:
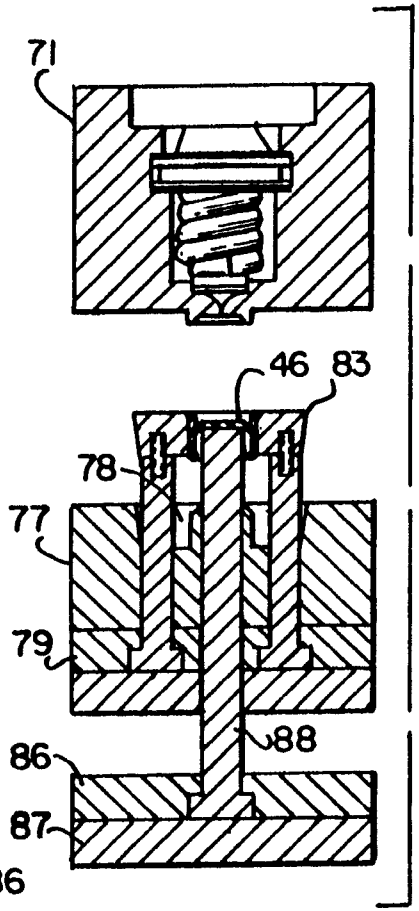
Figure 17:
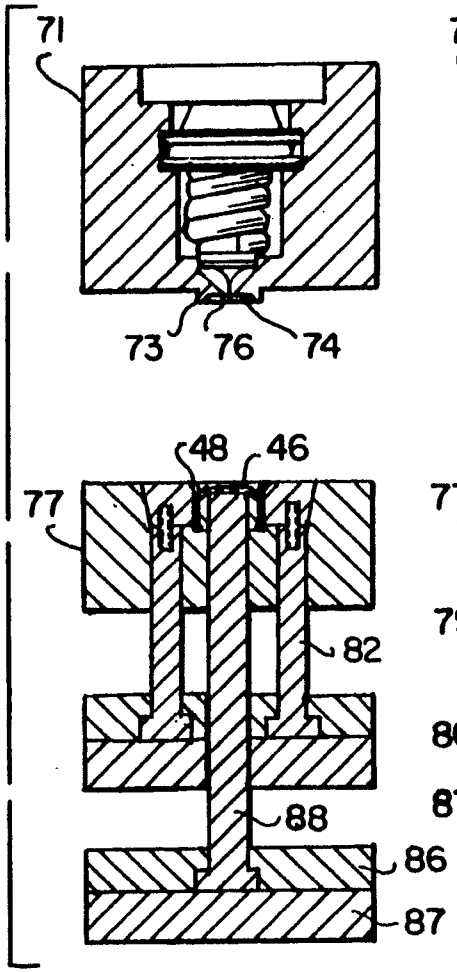

Abutting the bottom face of mold part 71 is core plate 77 formed with essentially annular core cavity 78 (see FIG. 18). The inner surface of cavity 78 determines the shape of the underside of plug wall 50 and the inside of skirt 49 as well as the shape of in-turned flange 51. Below plate 77 is first stage ejector clamp plate 79 and below plate 79 is first stage ejector support plate 81. Between plates 79 and 81 are clamped the lower ends of ejector ring pins 82. On the upper end of pins 82 is the ejector ring 83 which is formed with a cavity 84 (see especially FIG. 19) which is complementary to the exterior of plug flange 48, groove 52 and the outside of skirt 49.

Below plate 81 is second stage ejector plate 86 and below that is the second stage ejector support plate 87. Between them they clamp the lower end of ejector pin 88.

Figure 19:
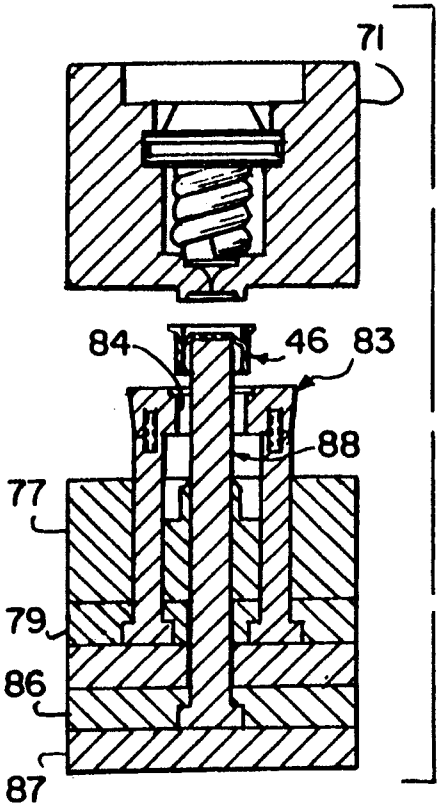
FIGS. 17, 18 and 19 are views similar to FIG. 15 showing mold parts in sequented positions of the molding operation.
Figure 16:
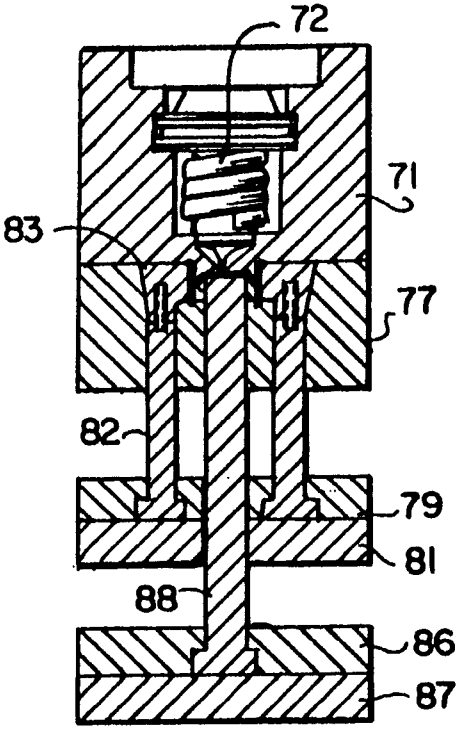
FIG. 16 is a schematic sectional view showing a plug and mold parts for producing same at a first stage in molding the plug.

In operation, the parts are in the condition shown in FIG. 16 during the molding of plug 46. The cross-sectional shape of plug 46 is shown in solid black lines in FIGS. 16–19. After the plastic flowing through gate 76 has completely filled the mold, the hot side mold part 71 is withdrawn to the position of FIG. 17. The next stage in operation of the mold is shown in FIG. 18 whereby plates 79 and 81 are moved upward, causing the pins 82 to raise the ejector ring 83. This operation strips the plug 46 from contact with the core 77. The final stage of operation is shown in FIG. 19 whereby the plates 86 and 87 have been projected causing the ejector pin 88 to push the plug 46 out of the ejector ring 83. Because of the undercut between extension 101 and wall 50, extension 101 can deform inward, allowing flange 48 to be pushed free of ejector ring 83. The plug 46 then drops off the pin 88 and the mold parts return to the position of FIG. 15 for the next cycle of operation.

The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

For convenience in explanation and accurate definition in the appended claims, the terms "up" or "upper" and "down" or "lower" to describe features of cap 26 and plug 46 refer to the positions of those members displayed in FIGS. 4 and 5, respectively.

In many respects the modifications of FIGS. 9, 11, 12, 13, 14 and 15 resemble those of the preceding modifications and the same reference numerals, followed by subscripts a, b, c, d, e, and f, designate corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A closure for a container having a neck formed with a lip and a surrounding bead comprising, a unitary cap having a cap top shaped to fit over said neck formed with a well having a side wall having an interior and an exterior and an open bottom, said well side wall interior having an inner bead located adjacent a distal end of said well, a cap skirt depending from said cap top shaped to fit around said lip and surrounding bead and having cap retention means cooperable with said neck to hold said cap on said neck in liquid-tight manner, a plug for said well having a plug top and a plug wall connected to said plug top at a circular junction, said plug wall having an interior and an exterior, a flange projecting outward from said plug wall larger than said well side wall interior to limit inward movement of said plug relative to said well, said plug wail exterior being formed with a circumferential groove and a shoulder below said groove located adjacent an end of said plug wall exterior remote from said plug top, said shoulder being dimensioned to restrain said plug from unintentional withdrawal from said well by engaging said inner bead, a portion of said plug wall exterior being dimensioned to seal against a portion of said well side wall interior when said plug is fully seated within said well.

2. A closure according to claim 1 in which said portion of said plug wall exterior comprises said groove.

3. A closure according to claim 2 in which said groove is characterized by the absence of vertical mold parting lines.

4. A closure according to claim 1 in which said plug wall exterior is formed with a circumferential seal bead said circumferential groove, said portion of said plug wall exterior comprising said seal bead.

5. A closure according to claim 4 in which said seal bead and said inner bead are characterized by the absence of vertical mold parting lines.

6. A closure according to claim 1 in which said plug wall exterior is formed with at least one longitudinal groove extending to adjacent a bottom edge of said plug, said closure being characterized in that communication between said container and atmosphere is established through said at least one longitudinal groove as soon as said portion of said well side wall interior is moved below said portion of said plug wall exterior.

7. A closure according to claim 1 in which said plug wall has a cylindrical extension extending substantially above said circular junction.

8. A closure according to claim 7 in which said plug top comprises a top wall extending downwardly-outwardly to said plug wall, and intersecting said interior of said plug wall at said circular junction, said circular extension being above said junction, said circular extension being flexible inwardly, said flange being located on said extension.

9. A closure according to claim 7 in which said plug top is dome shaped and has a lower portion intersecting said plug wall at said circular junction.

10. A closure according to claim 9 in which said plug wall has an extension extending substantially above said circular junction, said flange being located on said extension.

11. A closure according to claim 1 in which said plug top comprises a top wall of diameter smaller than said plug wall and which further comprises a downward-outward slanted wall intersecting said interior of said plug wall at said circular junction, said extension extending substantially above said circular junction.

12. A closure according to claim 11 in which said flange is below said slanted wall.

13. A closure according to claim 6 in which said plug wall exterior is formed with a first circumferential groove and a second circumferential groove below said first circumferential groove and a seal bead between said first and second circumferential grooves, said seal bead comprising said portion of said plug wall exterior.

14. A closure according to claim 13 in which said at least one longitudinal groove communicates with said second circumferential groove.

15. A closure according to claim 6 which further comprises a notch formed in a lower edge of said plug skirt aligned with said at least one longitudinal groove.

16. A closure according to claim 1 in which said cap and said well side wall interior are characterized by having no vertical seams.

17. A closure according to claim 1 in which said cap retention means comprises a rounded corner curving downwardly-outwardly of said cap top, at least one inwardly projecting circumferential seal bead on the inside of said rounded corner, said corner being intermediate said cap top and said cap skirt, and a tension ring on the inside of said skirt positioned to fit under said bead of said neck and draw said seal beads tightly against said neck lip and bead.

18. A closure according to claim 17 in which said closure is tamper evident and which further comprises a first score line extending around at least a portion of the inside of said skirt immediately below said tension ring, a second score line extending upwardly from the bottom edge of said cap skirt to merge with said first score line and a tab depending from the bottom edge of said cap skirt, said cap skirt being dimensioned to fit tightly around said container neck until the portion of said cap skirt below said first score line has been loosened from said neck by pulling on said tab to tear said cap skirt along said second score line and at least a portion of said first score line.

19. A closure according to claim 2 wherein said plug flange is located above the level of said plug top, and said circumferential groove is formed below said flange, whereby said skirt vicinal said groove is flexible.

20. A closure according to claim 19 in which said plug top comprises a closed end of diameter smaller than said plug wall and a downward-outward slanted wall extending from said closed end and intersecting said plug wall below the level of said circumferential groove.

21. In combination, a closure according to claim 1 and a dispenser tube having a tube end smaller than said plug wall interior and a circumferential tube groove below said tube end, said plug further comprising an in-turned flange at a lower edge of said plug wall shaped to fit into said dispenser tube circumferential groove to detachably secure said plug to said tube when said tube end is inserted inside said plug wall.

22. The combination of claim 21 wherein said dispenser tube below said tube groove is dimensioned to fit inside said well with a sliding, liquid-tight fit.

23. A combination according to claim 21 which further comprises an adapter having a cylindrical portion surrounding said dispenser tube and wherein said cap skirt has an outside bead dimensioned to fit inside said cylindrical portion with a sliding, liquid-tight fit.

24. The combination of claim 21 wherein the inside of the lower end of said well is formed with a first chamfer and the outside of said plug wall is formed with a second chamfer at its lower end, said chamfers facilitating insertion of said plug in said well.

25. A closure according to claim 1 in which said plug wall exterior comprises a portion having no seam thereon, said well having at least a portion that is seamless, said portion of said plug wall exterior and said portion of said well wall interior sealing against each other when said plug is fully seated in said well.

26. A closure for a container of the type having a neck formed with a lip and a surrounding bead comprising a unitary cap having a cap top shaped to fit over said neck formed with a well having a seamless cylindrical interior and an open bottom, a cap skirt depending from said top shaped to fit around said lip and bead and having cap retention means cooperable with said neck to hold said cap on said neck in liquid-tight manner, a plug for said well having a plug top and a cylindrical member surrounding and attached to said plug top, said cylindrical member comprising a plug skirt, a flange projecting outward from said cylindrical member larger than the inside of said well to limit inward movement of said plug relative to said well, an outside wall of said cylindrical member being smaller in diameter than said flange and said outside wall being formed with a circumferential groove, said cylindrical member having a portion having an outside diameter dimensioned to form with said interior side wall of said well a liquid-tight fit, said plug top being formed with a closed end smaller than said cylindrical member and a downward-outward directed wall merging with said cylindrical member, there being a space between said downward-outward directed wall and said cylindrical member opposite said circumferential groove to permit said cylindrical member to deform inwardly at said circumferential groove, said well being formed with an in-turned inner bead adapted to fit into said groove to hold said plug fully seated in said well, a portion of said cylindrical member being characterized by the fact that it has an outside surface with no vertical seam thereon, said well being characterized by the fact that said well has no vertical seam, said cylindrical member vicinal said groove being flexible, whereby said cylindrical member may be collapsed inwardly.

27. A closure according to claim 26 in which said outside wall has a shoulder below said groove, said well being formed with an inner bead adapted to engage said shoulder to restrain said plug in said well against unintentional dislodgement.

* * * * *